US009504925B2

(12) United States Patent
Lauer

(10) Patent No.: US 9,504,925 B2
(45) Date of Patent: Nov. 29, 2016

(54) DOLL OR ACTION FIGURE WITH FACIAL FEATURES CUSTOMIZED TO A PARTICULAR INDIVIDUAL

(71) Applicant: Right Foot LLC, Los Angeles, CA (US)

(72) Inventor: Daniel J. Lauer, St. Louis, MO (US)

(73) Assignee: RIGHT FOOT LLC, Los Angeles, CA (US)

( * ) Notice: Subject to any disclaimer, the term of this patent is extended or adjusted under 35 U.S.C. 154(b) by 0 days.

(21) Appl. No.: 14/615,422

(22) Filed: Feb. 5, 2015

(65) Prior Publication Data

US 2015/0231516 A1 Aug. 20, 2015

Related U.S. Application Data

(60) Provisional application No. 61/940,270, filed on Feb. 14, 2014.

(51) Int. Cl.

| | |
|---|---|
| ***A63H 3/16*** | (2006.01) |
| ***A63H 3/36*** | (2006.01) |
| ***A63H 3/44*** | (2006.01) |

(52) U.S. Cl.

CPC ..... *A63H 3/365* (2013.01); *A63H 3/44* (2013.01)

(58) Field of Classification Search

USPC ..... 446/97, 100, 321, 337, 339, 391, 394, 446/395; 434/100, 267, 270

See application file for complete search history.

(56) References Cited

U.S. PATENT DOCUMENTS

| | | | | | |
|---|---|---|---|---|---|
| 2,199,049 | A | * | 4/1940 | Greenberg | A63H 3/16 446/100 |
| 4,020,586 | A | | 5/1977 | Benner | |
| 4,414,774 | A | * | 11/1983 | Fogarty et al. | 446/98 |
| 4,573,927 | A | * | 3/1986 | Newman | A63F 9/10 428/542.2 |
| 5,090,910 | A | * | 2/1992 | Narlo | G09B 23/34 434/100 |
| 5,141,466 | A | * | 8/1992 | Catizone | 446/391 |
| 5,280,305 | A | | 1/1994 | Monroe et al. | |
| 5,403,224 | A | * | 4/1995 | Gintling | 446/321 |
| 5,676,584 | A | | 10/1997 | Perryman | |
| 5,803,788 | A | * | 9/1998 | Penberthy et al. | 446/391 |
| 5,947,791 | A | | 9/1999 | Taylor | |
| 5,995,110 | A | | 11/1999 | Litwinowicz | |

(Continued)

FOREIGN PATENT DOCUMENTS

| | | |
|---|---|---|
| JP | 2004-261620 | 9/2004 |
| JP | 2010-183946 | 8/2010 |

(Continued)

OTHER PUBLICATIONS

International Search Report and Written Opinion for PCT/US2015/014937 Dated: May 14, 2015 pp. 9.

(Continued)

*Primary Examiner* — Kurt Fernstrom
(74) *Attorney, Agent, or Firm* — Harness, Dickey & Pierce, P.L.C.

(57) ABSTRACT

A doll or action figure with facial features customized to a particular individual includes a body; a head on the body, hair on the top, sides, and back of the head, and a mask-receiving recess on the front of the face, the mask-receiving recess having a perimeter extending across the top of the head adjacent the hair line, and generally downwardly at each side of the head adjacent the hairline; and a mask having facial features customized to the particular individual, seated in the mask-receiving recess on the front of the face.

11 Claims, 11 Drawing Sheets

(56) References Cited

U.S. PATENT DOCUMENTS

| | | | | |
|---|---|---|---|---|
| 6,099,378 | A * | 8/2000 | George et al. | 446/391 |
| 6,183,338 | B1 * | 2/2001 | Mallette | A63H 3/12 446/321 |
| 6,204,858 | B1 | 3/2001 | Gupta | |
| 6,453,052 | B1 | 9/2002 | Kurokawa et al. | |
| D466,565 | S * | 12/2002 | Borgaro et al. | D21/577 |
| 6,491,565 | B1 * | 12/2002 | McCullough | 446/391 |
| 6,511,359 | B1 * | 1/2003 | Lui | 446/321 |
| 6,758,717 | B1 * | 7/2004 | Park et al. | 446/391 |
| 6,782,128 | B1 | 8/2004 | Rinehart | |
| 6,945,841 | B2 * | 9/2005 | Becker et al. | 446/100 |
| 7,186,212 | B1 * | 3/2007 | McMullen | 600/38 |
| 7,946,901 | B2 * | 5/2011 | Roberts | 446/321 |
| 8,070,553 | B2 * | 12/2011 | Carnegie | 446/369 |
| 8,162,712 | B1 * | 4/2012 | Uy | 446/369 |
| 8,172,638 | B2 * | 5/2012 | Silva et al. | 446/227 |
| 8,888,553 | B2 * | 11/2014 | McMullen | 446/321 |
| 2001/0011341 | A1 | 8/2001 | Hayes et al. | |
| 2003/0236050 | A1 * | 12/2003 | Landry | 446/369 |
| 2004/0041804 | A1 | 3/2004 | Ives et al. | |
| 2004/0077274 | A1 | 4/2004 | Becker et al. | |
| 2006/0003111 | A1 | 1/2006 | Tseng | |
| 2006/0126924 | A1 | 6/2006 | Liu et al. | |
| 2007/0091085 | A1 | 4/2007 | Wang et al. | |
| 2007/0237908 | A1 | 10/2007 | Garnett | |
| 2008/0300704 | A1 | 12/2008 | Watkins et al. | |
| 2009/0153552 | A1 | 6/2009 | Fidaleo et al. | |
| 2009/0196475 | A1 | 8/2009 | Demirli et al. | |
| 2011/0069157 | A1 | 3/2011 | Ito et al. | |
| 2011/0234581 | A1 | 9/2011 | Eikelis et al. | |
| 2012/0134558 | A1 | 5/2012 | Sienkiewicz | |
| 2012/0142250 | A1 * | 6/2012 | Andersen | A63H 3/365 446/321 |
| 2012/0162379 | A1 | 6/2012 | Dahi et al. | |
| 2012/0185218 | A1 | 7/2012 | Bickel et al. | |
| 2012/0223956 | A1 | 9/2012 | Saito et al. | |
| 2012/0299918 | A1 | 11/2012 | Abeloe | |
| 2013/0009979 | A1 | 1/2013 | Harvill | |
| 2013/0307848 | A1 | 11/2013 | Tena et al. | |

FOREIGN PATENT DOCUMENTS

| | | |
|---|---|---|
| WO | WO 2014/092740 | 6/2014 |
| WO | WO 2014/093873 | 6/2014 |

OTHER PUBLICATIONS

International Search Report and Written Opinion for PCT/US2012/069959 Dated: Mar. 29, 2013 pp. 6.

International Search Report for PCT/US2013/075102 Dated: May 23, 2014 pp. 2.

International Search Report and Written Opinion for PCT/US2015/046755 Dated: Dec. 4, 2015 pp. 14.

D'Apuzzo, N., "Measurement and Modeling of Human Faces from Multi Images"; International Archives of Photogrammetry and Remote Sensing; Publication [online] 2002; [retrieved Oct. 25, 2015] <URL:http://www.hometrica.ch/pub1/2002_face_b.pdf>; pp. 241-246.

Pighin, F., et al., "Synthesizing Realistic Facial Expressions from Photographs"; 1998; Publication [online] 1998; [retrieved Oct. 25, 2015]; <URL:http://research.microsoft.com/pubs/68336/Pighin-SG98.pdf>; pp. 1-10.

Bui, T., "Creating Emotions and Facial Expressions for Embodied Agents"; Publication [online], Ph.D. Thesis; 2004; [retrieved Oct. 25, 2015]; <URL:http://eprints.eemcs.utwente.nl/6570/01/thesis_The_Duy_Bui.pdf>; pp. 1-223.

International Search Report and Written Opinion for PCT/US2015/014936 Dated: Aug. 28, 2015 pp. 23.

International Preliminary Report on Patentability for PCT/US2012/069959 Dated: Jun. 16, 2015 pp. 5.

International Preliminary Report on Patentability for PCT/US2013/075102 Dated: Jun. 16, 2015 pp. 7.

* cited by examiner

DOLL OR ACTION FIGURE WITH FACIAL FEATURES CUSTOMIZED TO A PARTICULAR INDIVIDUAL

CROSS-REFERENCE TO RELATED APPLICATIONS

This application claims priority to U.S. Provisional Patent Application Ser. No. 61/940,270 filed Feb. 14, 2014. The entire disclosure of the above application is incorporated herein by reference.

BACKGROUND

This section provides background information related to the present disclosure which is not necessarily prior art.

This invention relates to dolls or action figures with facial features customized to a particular individual.

Dolls and actions figures that are customized to resemble particular people are highly desirable, but because they must be custom made, requiring skilled labor and expensive equipment, they take a long time to produce and can be expensive. Improvements in technology including scanners and 3D printers allow custom heads or custom heads and bodies to be made, but the process still takes time, is expensive, and the results are not very realistic.

SUMMARY

This section provides a general summary of the disclosure, and is not a comprehensive disclosure of its full scope or all of its features.

Embodiments of the present invention provide a doll or action figure with facial features customized to a particular individual. According to a preferred embodiment the doll or action figure comprises a head having hair on the top, sides, and back of the head, and a mask-receiving recess on the front of the face, the mask-receiving recess having a perimeter extending across the top of the head adjacent the hair line, and generally downwardly at each side of the head adjacent the hairline. A mask having facial features customized to the particular individual, is seated in the mask-receiving recess.

In some embodiments, the hair is molded on the surface of the head. In other embodiments the hair comprises filaments that project from the head.

In the preferred embodiment the mask includes an ear at each side, a portion of which projects beyond the perimeter of the mask, so that when the mask is seated in the mask-receiving recess, the ears project beyond the end of the mask and overlapping the juncture between the mask and the mask-receiving recess.

In at least some preferred embodiments, the side perimeters of the mask-receiving recess extend generally downwardly and rearwardly at each side of the head, to a point intermediate the top and bottom of the head, and then from this point generally downwardly and forwardly to a point at the front of the neck below the head.

In some embodiments the perimeter of the mask-receiving recess extends across the front of the neck, and the mask includes a chin.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
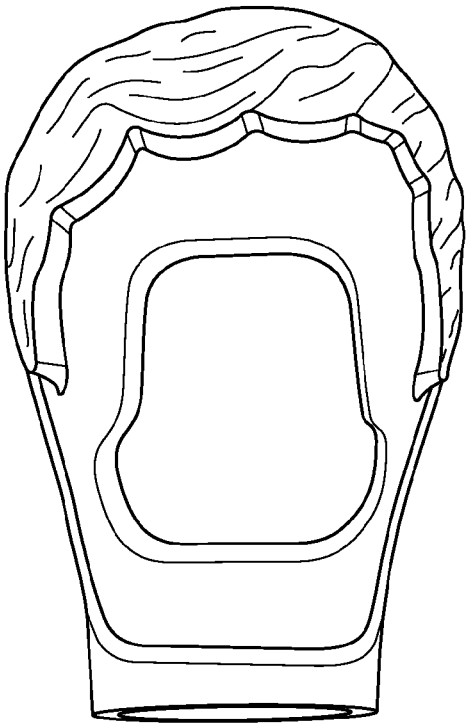
FIG. 1 is a front elevation view of a head with a mask-receiving recess in accordance with a first preferred embodiment of this invention.
Figure 4:
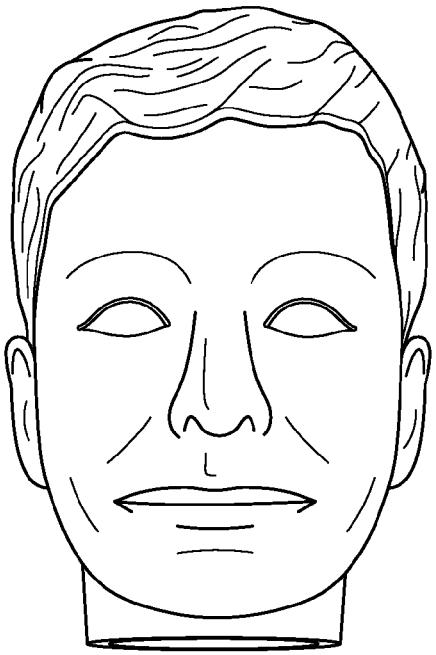
FIG. 4 is a front elevation view of the head shown in FIG. 1-3, with a mask in the mask-receiving recess.
Figure 6:
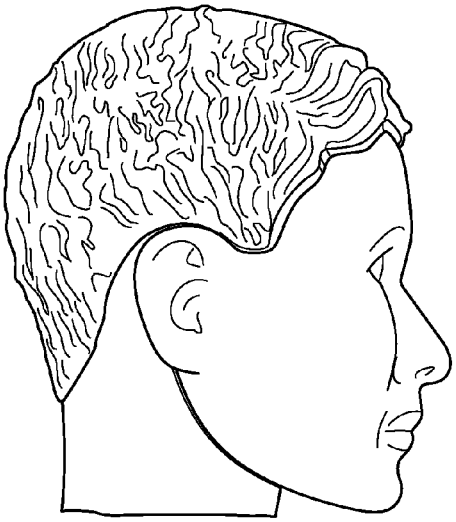
FIG. 6 is a right side elevation view of a head shown in FIG. 1-3, with a mask in the mask-receiving recess.
Figure 5:
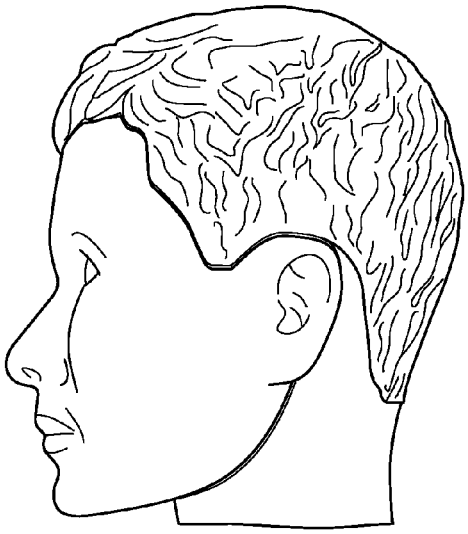
FIG. 5 is a left side elevation view of a head shown in FIG. 1-3, with a mask in the mask-receiving recess.
Figure 7:
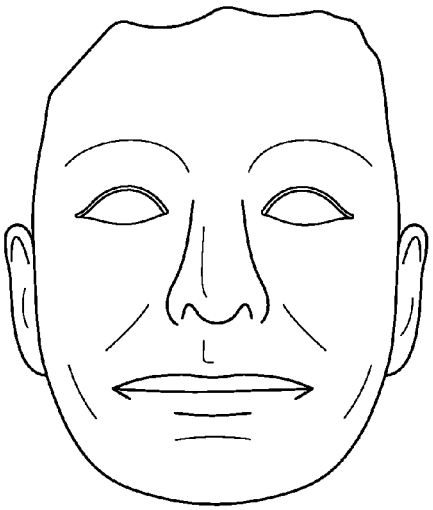
FIG. 7 is a front elevation view of the mask shown in FIGS. 4-6.
Figure 8:
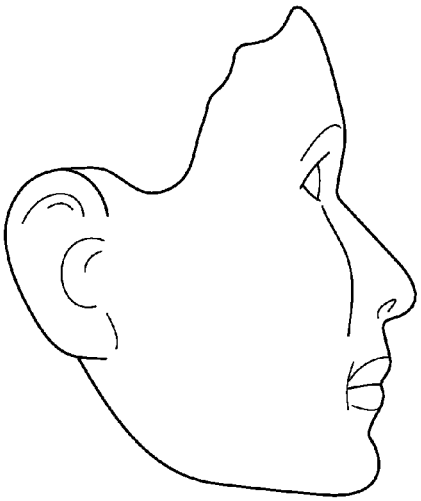
FIG. 8 is a right side elevation view of the mask shown in FIGS. 4-6.
Figure 9:
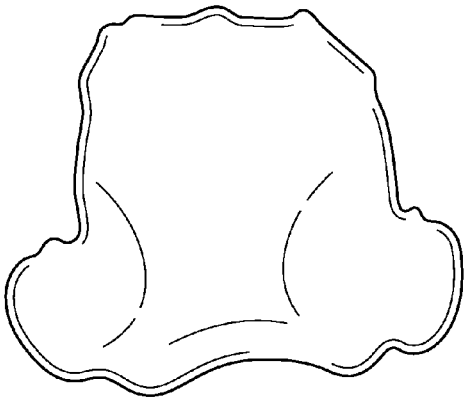
FIG. 9 is a rear elevation view of the mask shown in FIGS. 4-6.
Figure 10:
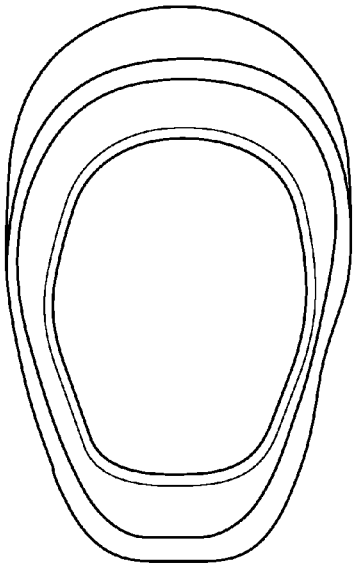
FIG. 10 is a front elevation view of a head with a mask-receiving recess in accordance with a second preferred embodiment of this invention.

Embodiments of the present invention provide a doll or action figure with facial features customized to a particular individual. Doll includes dolls of any kind and size and material, and similarly action figure includes action figures of any kind and size and material. According to a first preferred embodiment shown in FIGS. 1-9, a doll or action figure comprises at least a head 22 having hair 24 on the top 26, left and right sides 28, 30, and back 32 of the head. There is a mask-receiving recess 34 on the front of the head 22, the mask-receiving recess having a perimeter 36, with a portion 36A extending across the top of the head adjacent the hair line, and left and right side portions 36B, 36C extending generally downwardly on the left and right sides of the head 22 adjacent the hairline. As shown in FIGS. 7-9 mask 40 has facial features, including eyes 42, 44, nose 46, and mouth 48 customized to the particular individual. As shown in FIGS. 4-6, the mask 40 is seated in the mask-receiving recess 34 of the head 22.

In some embodiments, the hair 34 is molded on the surface of the head, as shown in FIGS. 1-6. In other embodiments the hair can comprises filaments that project from the head. These filaments can be formed integrally with the head, or secured with adhesive, or "rooted" through a network of holes formed in the head.

In the preferred embodiment the mask 40 includes ears 50, 52 at each side. A portion of each of the ears 50, 52 preferably projects beyond the perimeter of the mask 40, so that when the mask is seated in the mask-receiving recess 34, the ears project beyond the edge of the mask and overlap (and thus hide) the juncture between the mask and the mask-receiving recess.

Figure 3:
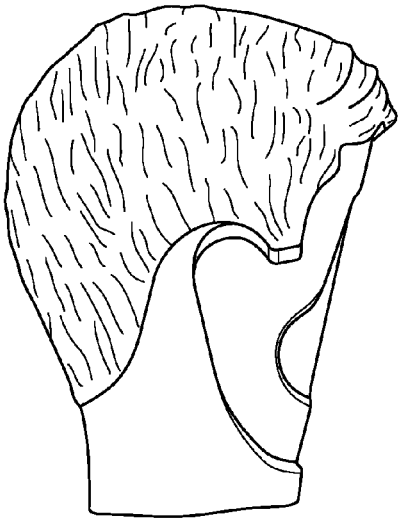
FIG. 3 is a right side elevation view of the head of FIG. 1.
Figure 2:
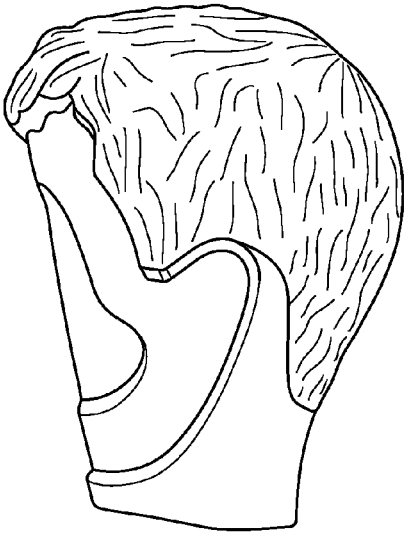
FIG. 2 is a left side elevation view of the head of FIG. 1.

In at least some preferred embodiments, as shown in FIGS. 2 and 3 the side perimeters 36B, 36C of the mask-receiving recess 34 extend generally downwardly and rearwardly at each side of the head, to a point 54 intermediate the top 26 and bottom of the head 22, and then from this point generally downwardly and forwardly to a point at the front of the neck 56 at the bottom of the head. While the perimeter 36B generally follows a downwardly, rearwardly direction, it is not necessarily a straight line, and may deviate, for example to accommodate sideburns or other hair features, as shown in FIGS. 2 and 3.

In some embodiments the perimeter of the mask-receiving recess extends across the front of the neck 56, and the mask includes a chin. In other embodiments there is no recess across neck 56, and the mask simply overlies the neck.

Figure 17:
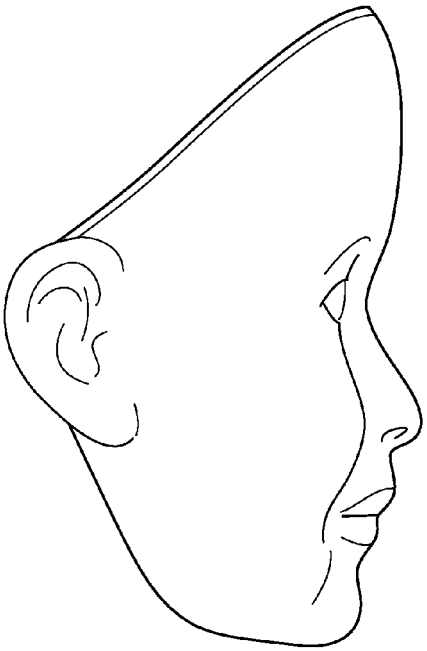
FIG. 17 is a left side elevation view of the mask shown in FIGS. 13-15.
Figure 16:
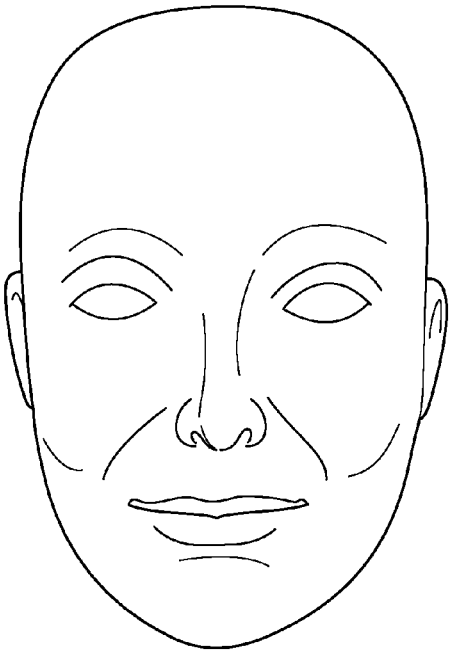
FIG. 16 is a front elevation view of the mask shown in FIGS. 13-15.
Figure 18:
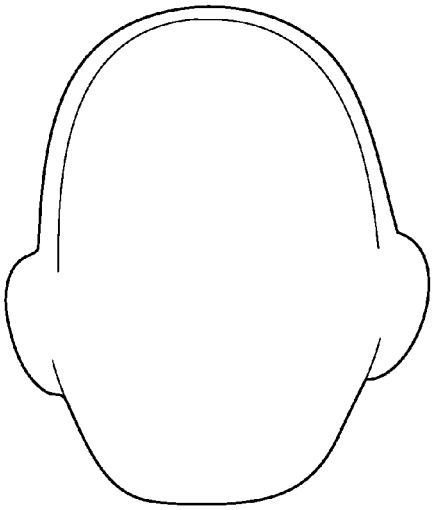
FIG. 18 is a rear elevation view of the mask shown in FIGS. 13-15.
Figure 20:
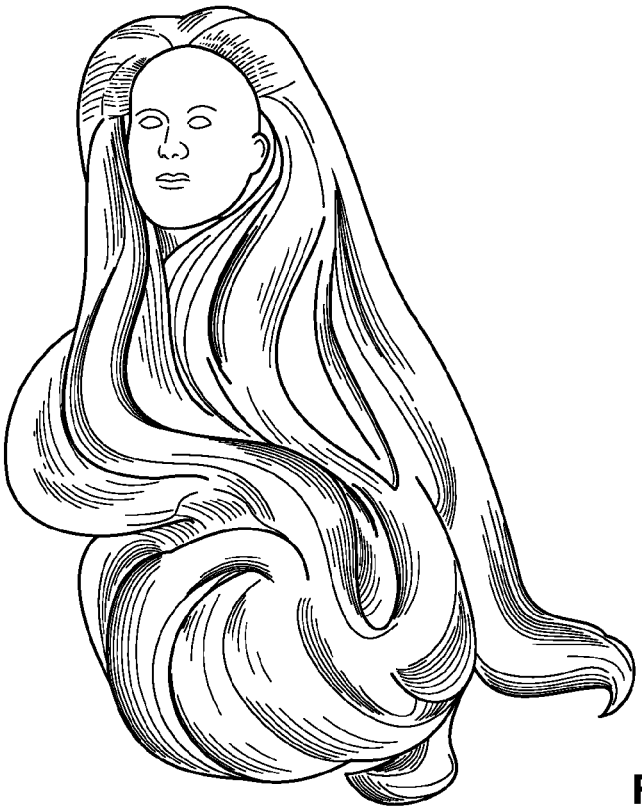
FIG. 20 is a photograph showing mask installed in the mask-receiving recess in a head with rooted hair.
Figure 19:
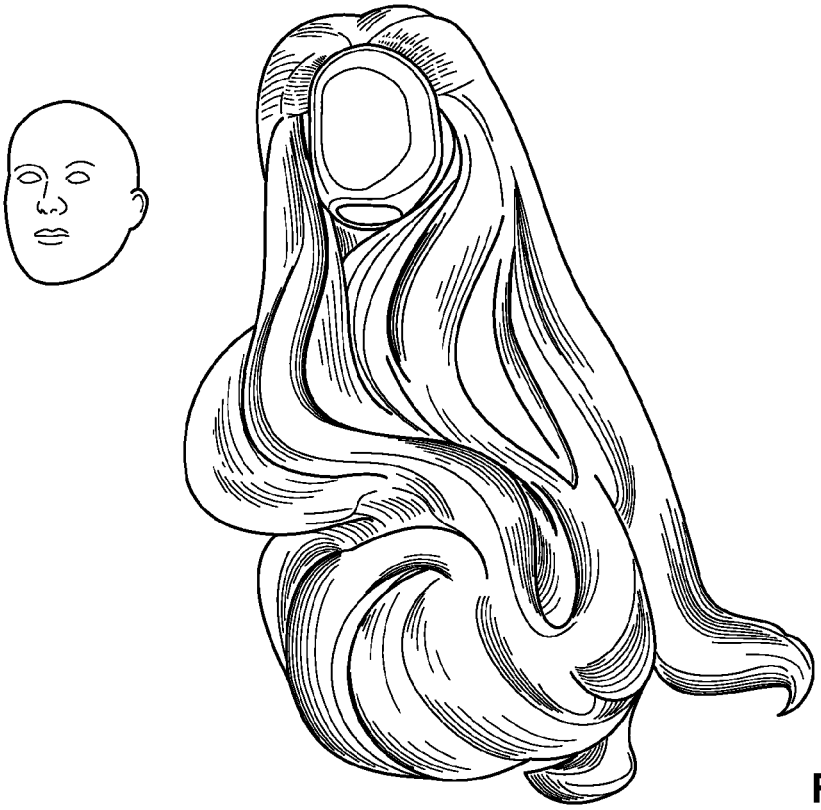
FIG. 19 is a photograph showing a head with rooted hair, and a corresponding mask.
Figure 21:
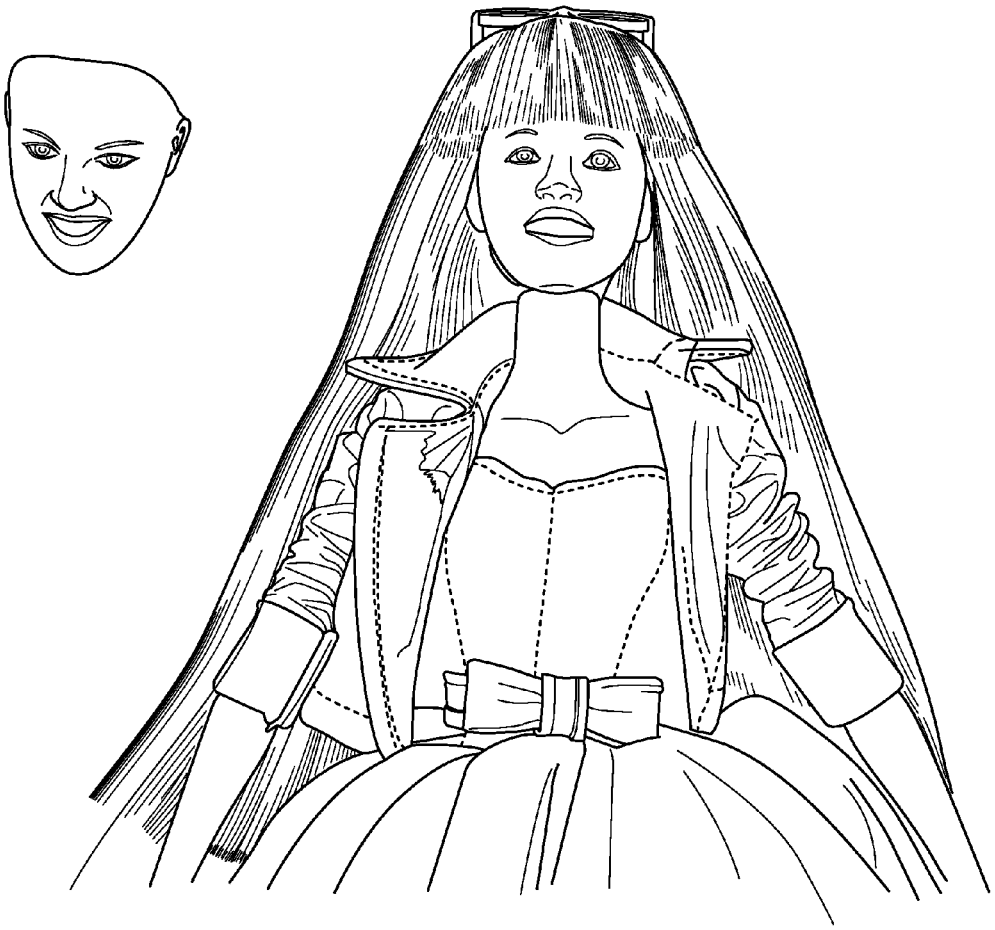
FIG. 21 is a photograph showing a doll with a head and body, with a mask installed thereon, and a duplicate of the mask.
Figure 22:
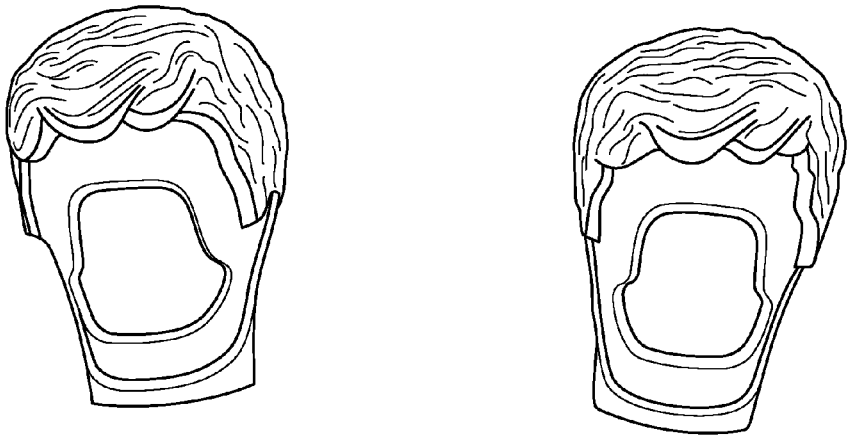
FIG. 22 is a photograph showing heads with mask-receiving portions of different skin tones in front elevation, with different hair colors.
Figure 23:
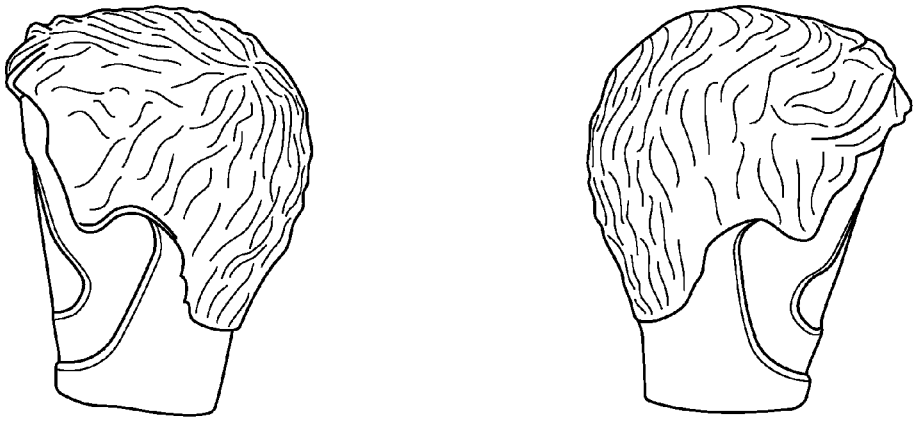
FIG. 23 is a photograph showing heads with mask-receiving portions of different skin tones, in side elevation, with different hair colors.
Figure 24:
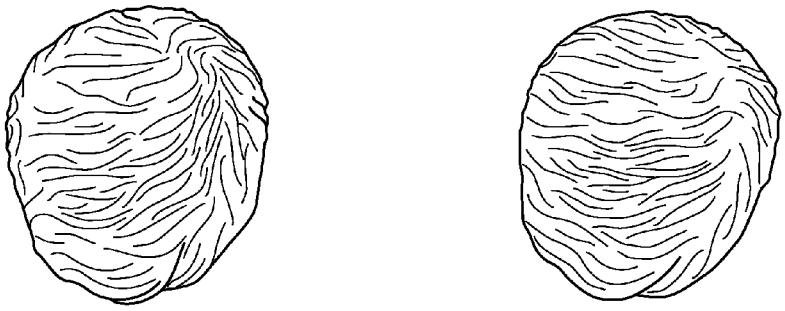
FIG. 24 is a photograph showing heads with mask-receiving portions of different skin tones, in top plan, with different hair colors.
Figure 26:
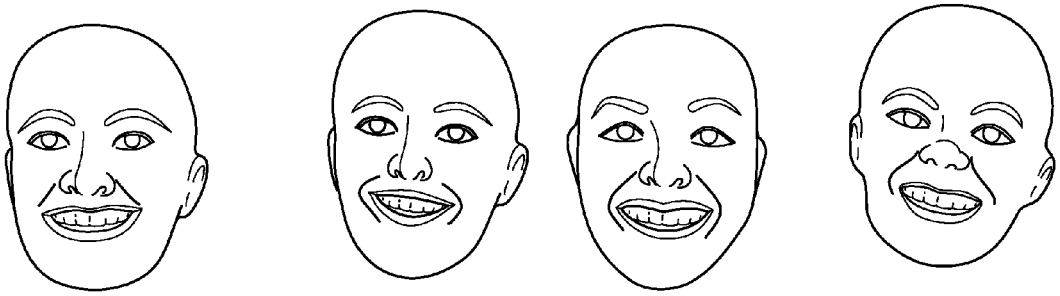
FIG. 26 is a photograph showing four different masks printed on a 3D color printer.
Figure 25A:
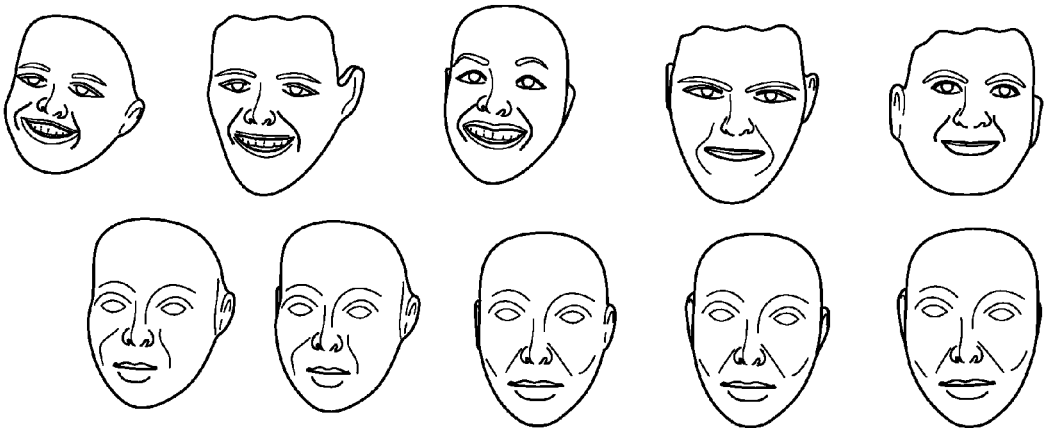
FIGS. 25A-25C are photographs showing five different masks printed on a 3D color printer.
Figure 25B:
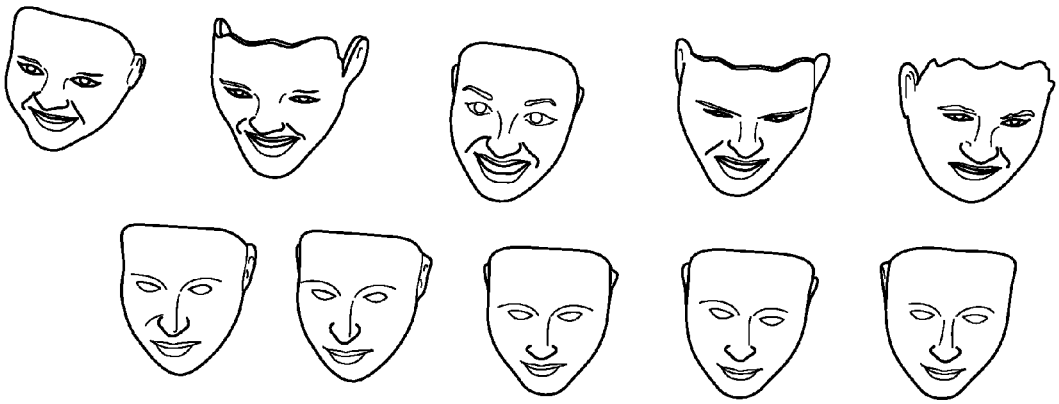
Figure 25C:
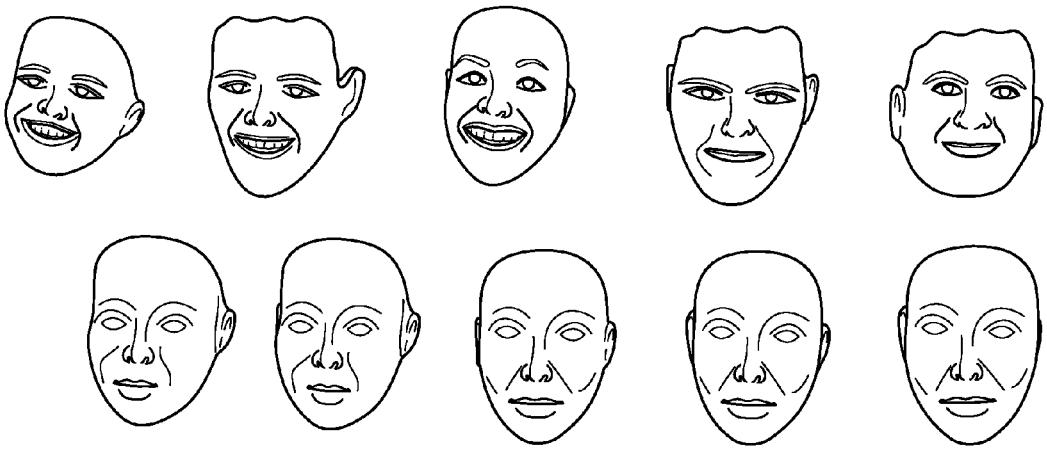

According to a second preferred embodiment shown in FIGS. 10-18, a doll or action figure comprises at least a head 122 having hair (which is not show in FIGS. 10-15 for clarity) on the top 126, left and right sides 28, 30, and back 32 of the head. There is a mask-receiving recess 34 on the front of the head 22, the mask-receiving recess having a perimeter 136, with a portion 136A extending across the top of the head adjacent the hair line, and left and right side portions 136B, 136C extending generally downwardly on the left and right sides of the head 122 adjacent the hairline. As shown in FIGS. 16-18 mask 140 has facial features, including eyes 142, 144, nose 146, and mouth 148 customized to the particular individual. As shown in FIGS. 4-6, the mask 140 is seated in the mask-receiving recess 134 of the head 122.

In some embodiments, the hair 134 is molded on the surface of the head, while in other embodiments the hair can comprises filaments that project from the head. These filaments can be formed integrally with the head, or secured with adhesive, or "rooted" through a network of holes formed in the head 122.

In the preferred embodiment the mask 140 includes ears 150, 152 at each side. A portion of each of the ears 150, 152 preferably projects beyond the perimeter of the mask 140, so that when the mask is seated in the mask-receiving recess 34, the ears project beyond the edge of the mask and overlap (and thus hide) the juncture between the mask and the mask-receiving recess.

Figure 12:
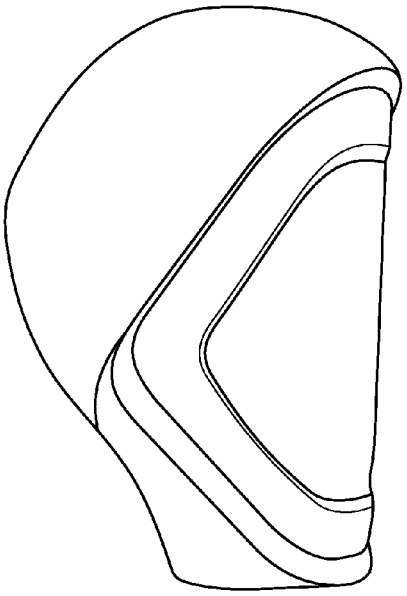
FIG. 12 is a right side elevation view of the head of FIG. 10.
Figure 11:
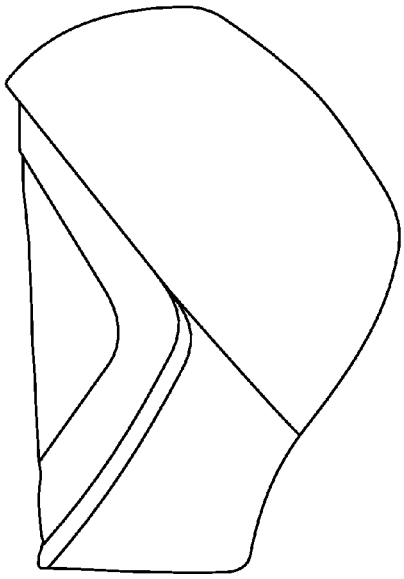
FIG. 11 is a left side elevation view of the head of FIG. 10.
Figure 13:
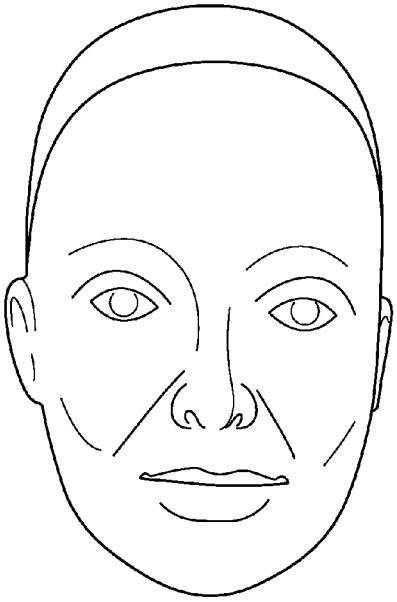
FIG. 13 is a front elevation view of the head shown in FIG. 10-12, with a mask in the mask-receiving recess.
Figure 14:
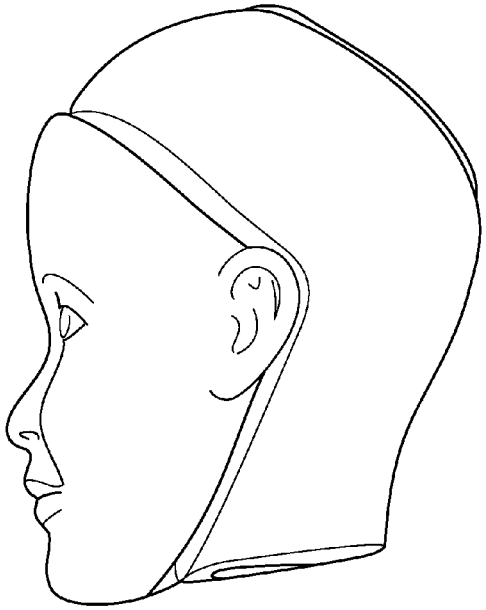
FIG. 14 is a left side elevation view of a head shown in FIG. 10-12, with a mask in the mask-receiving recess.
Figure 15:
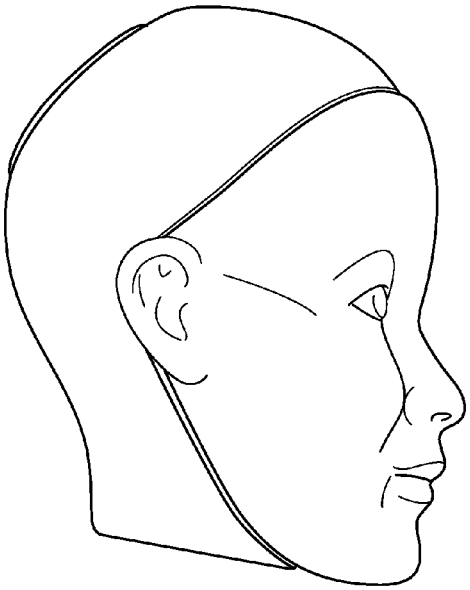
FIG. 15 is a right side elevation view of a head shown in FIG. 10-12, with a mask in the mask-receiving recess.

In at least some preferred embodiments, as shown in FIGS. 11 and 12 the side perimeters 136B, 136C of the mask-receiving recess 134 extend generally downwardly and rearwardly at each side of the head, to a point 154 intermediate the top 126 and bottom of the head 122, and then from this point generally downwardly and forwardly to a point at the front of the neck 156 at the bottom of the head. While the perimeter 136B generally follows a downwardly, rearwardly direction, it is not necessarily a straight line, and may deviate, for example to accommodate sideburns or other hair features.

In some embodiments the perimeter of the mask-receiving recess extends across the front of the neck 156, and the mask includes a chin. In other embodiments there is no recess across neck 156, and the mask simply overlies the neck or the bottom of the face portion of the head.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A doll or action figure with facial features customized to a particular individual, comprising:

a body;

a head on the body, hair on the top, sides, and back of the head, and a mask-receiving recess in the surface of the front of the face, the mask-receiving recess having a perimeter extending across the top of the head adjacent the hair line, and generally downwardly at each side of the head adjacent the hairline; and a mask having three-dimensional facial features customized to the particular individual, seated in the mask-receiving recess.

2. The doll or action figure according to claim 1 wherein the head and hair are molded plastic.

3. The doll or action figure according to claim 1 wherein the hair comprises filaments extending from the head.

4. The doll or action figure according to claim 1, wherein the mask includes an ear on each side, a portion of which projects beyond the perimeter of the mask receiving recess, over the head.

5. The doll or action figure according to claim 1 wherein the perimeter of the mask-receiving recess extends generally downwardly and rearwardly at each side of the head, to a point intermediate the top and bottom of the head, and then generally downwardly and forwardly.

6. The doll or action figure according to claim 4 wherein the perimeter of the mask-receiving recess extends across the front of the neck, and wherein the mask includes a chin.

7. The doll or action figure according to claim 1 wherein the perimeter of the mask-receiving recess extends across the front of the neck, and wherein the mask includes a chin.

8. A doll or action figure with facial features customized to a particular individual, comprising:

a body;

a head on the body, hair on the top, sides, and back of the head, and a mask-receiving recess in the surface of the front of the face, the mask-receiving recess having a perimeter extending across the top of the head adjacent the hair line, and generally downwardly and rearwardly at each side of the head, to a point intermediate the top and bottom of the head, and then generally downwardly and forwardly; and a mask having three-dimensional facial features customized to the particular individual, seated in the mask-receiving recess, the mask includes an ear or each side, a portion of which projects beyond the perimeter of the mask receiving recess, over the head.

9. The doll or action figure according to claim 8 wherein the head and hair are molded plastic.

10. The doll or action figure according to claim 8 wherein the hair comprises filaments projected from the head.

11. The doll or action figure according to claim 8 wherein the perimeter of the mask-receiving recess extends across the front of the neck, and wherein the mask includes a chin.

* * * * *